US006378735B1

(12) United States Patent
Chu

(10) Patent No.: US 6,378,735 B1
(45) Date of Patent: Apr. 30, 2002

(54) DEVICE FOR OBTAINING CONTENTS IN A CONTAINER AT DESIRED QUANTITY

(76) Inventor: Lien-Fang Chu, 5F-2, No. 3, Lane 103, Sec. 3, MinChuan E. Road, Taipei (TW)

( * ) Notice: Subject to any disclaimer, the term of this patent is extended or adjusted under 35 U.S.C. 154(b) by 0 days.

(21) Appl. No.: 09/827,384

(22) Filed: Apr. 4, 2001

(51) Int. Cl.[7] ..... B67D 5/38

(52) U.S. Cl. ..... 222/158; 222/548; 222/553; 222/567; 141/381; 141/383

(58) Field of Search ..... 222/158, 548, 222/553, 554, 570, 567; 141/379, 381, 380, 382, 384

(56) References Cited

U.S. PATENT DOCUMENTS

| | | | | | |
|---|---|---|---|---|---|
| 853,141 | A | * | 5/1907 | Wolff | 222/548 |
| 1,492,090 | A | * | 4/1924 | Van Tine | 222/542 |
| 2,877,937 | A | * | 3/1959 | Weir | 222/452 |
| 4,345,700 | A | * | 8/1982 | Souza | 222/438 |
| 4,346,823 | A | * | 8/1982 | Eppenbach | 222/443 |
| 4,380,307 | A | * | 4/1983 | Stillinger | 222/142.9 |
| 5,072,849 | A | * | 12/1991 | Blau | 220/253 |
| 5,123,574 | A | * | 6/1992 | Poulos | 222/362 |
| 5,477,895 | A | * | 12/1995 | Willard | 141/22 |
| 5,588,563 | A | * | 12/1996 | Liu | 222/158 |
| 5,772,086 | A | * | 6/1998 | Krafft | 222/438 |
| 5,944,230 | A | * | 8/1999 | Chiang | 222/158 |

* cited by examiner

*Primary Examiner*—Henry C. Yuen
*Assistant Examiner*—Frederick Nicolas

(57) ABSTRACT

A container assembly includes a container with a first cap mounted to the opening of the container and the first cap has a first aperture and a protrusion. A second cap is rotatably mounted to the first cap and has a slot for the protrusion being movably received therein. A second aperture is defined through the second cap and can be moved to communicate with the first aperture. A tube has a first open end rotatably engaged with the second aperture and an end member is rotatably connected to a second open end of tie tube. The contents in the container can be poured into the end member at desired quantity.

4 Claims, 5 Drawing Sheets

DEVICE FOR OBTAINING CONTENTS IN A CONTAINER AT DESIRED QUANTITY

FIELD OF THE INVENTION

The present invention relates to a device connected to a bottle or container and is able to obtain the contents in the container at desired quantity without opening the container.

BACKGROUND OF THE INVENTION

Conventional bottles or containers generally include an opening through which the contents in the container is accessed or taken. A cap is removably connected to the opening of the container so as to prevent dust from entering the container. When the contents a taken out, the user removes the cap from the container and tilts the container to pour the contents out, or the user uses a spoon to get the contents. However, for some contents, such as powders and tiny particles which have to be kept away from moisture, the contents are likely to be contaminated if the cap is removed frequently.

SUMMARY OF THE INVENTION

In accordance with one aspect of the present invention, there is provided a container assembly and comprises a container having an opening with which a first cap is mounted. The first cap has a first aperture and a protrusion extends from a top surface of the first cap. A second cap is rotatably mounted to the first cap and has a slot for the protrusion being movably received therein. A second aperture is defined through the second cap. A tube has a first open end rotatably engaged with the second aperture and an end member is rotatable connected to a second open end of the tube.

The primary object of the present invention is to provide a container assembly wherein the contents in the container can be obtained at desired quantity without opening the cap.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
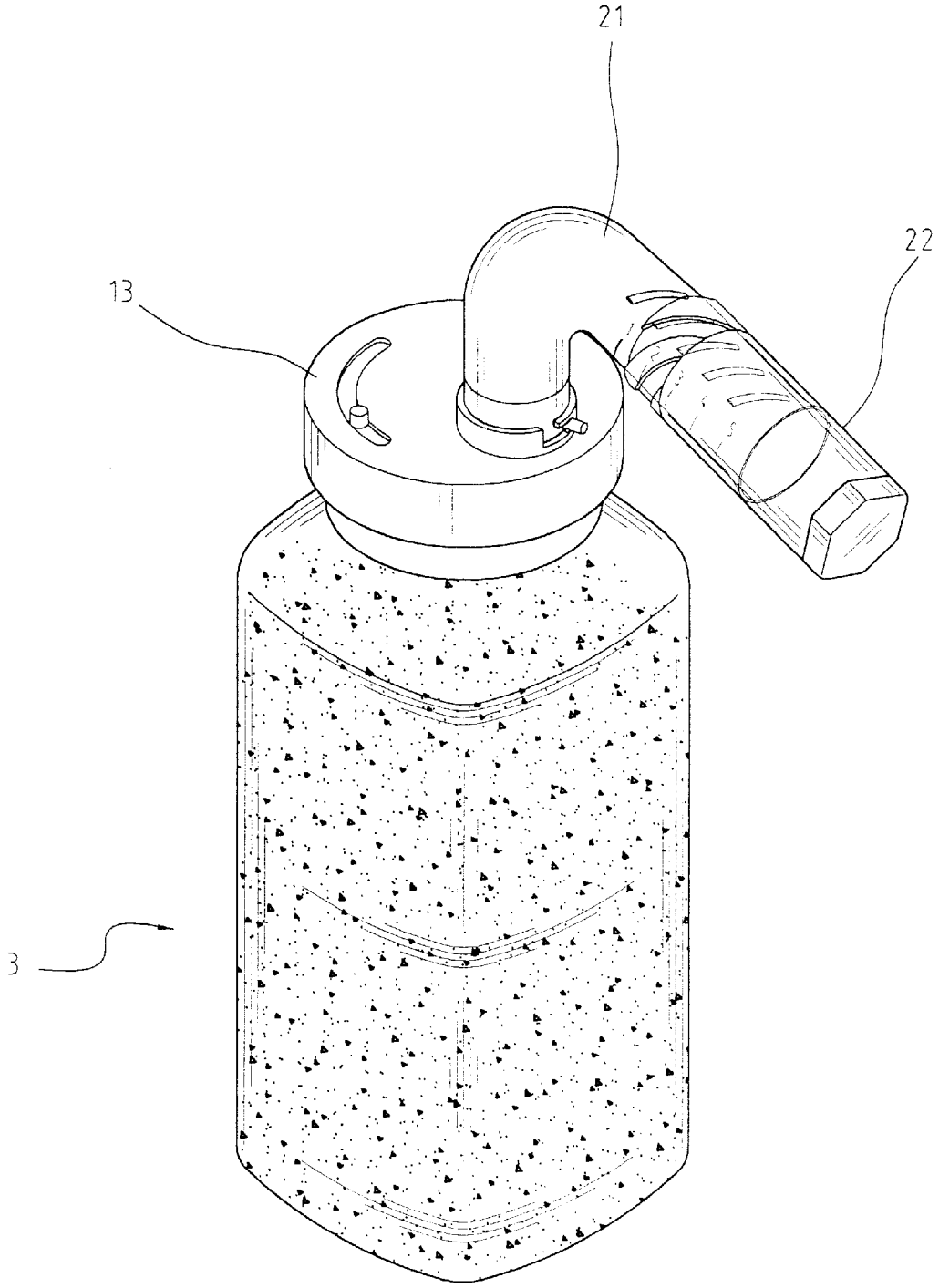
FIG. 1 is a perspective view to show the container assembly of the present invention.
Figure 2:
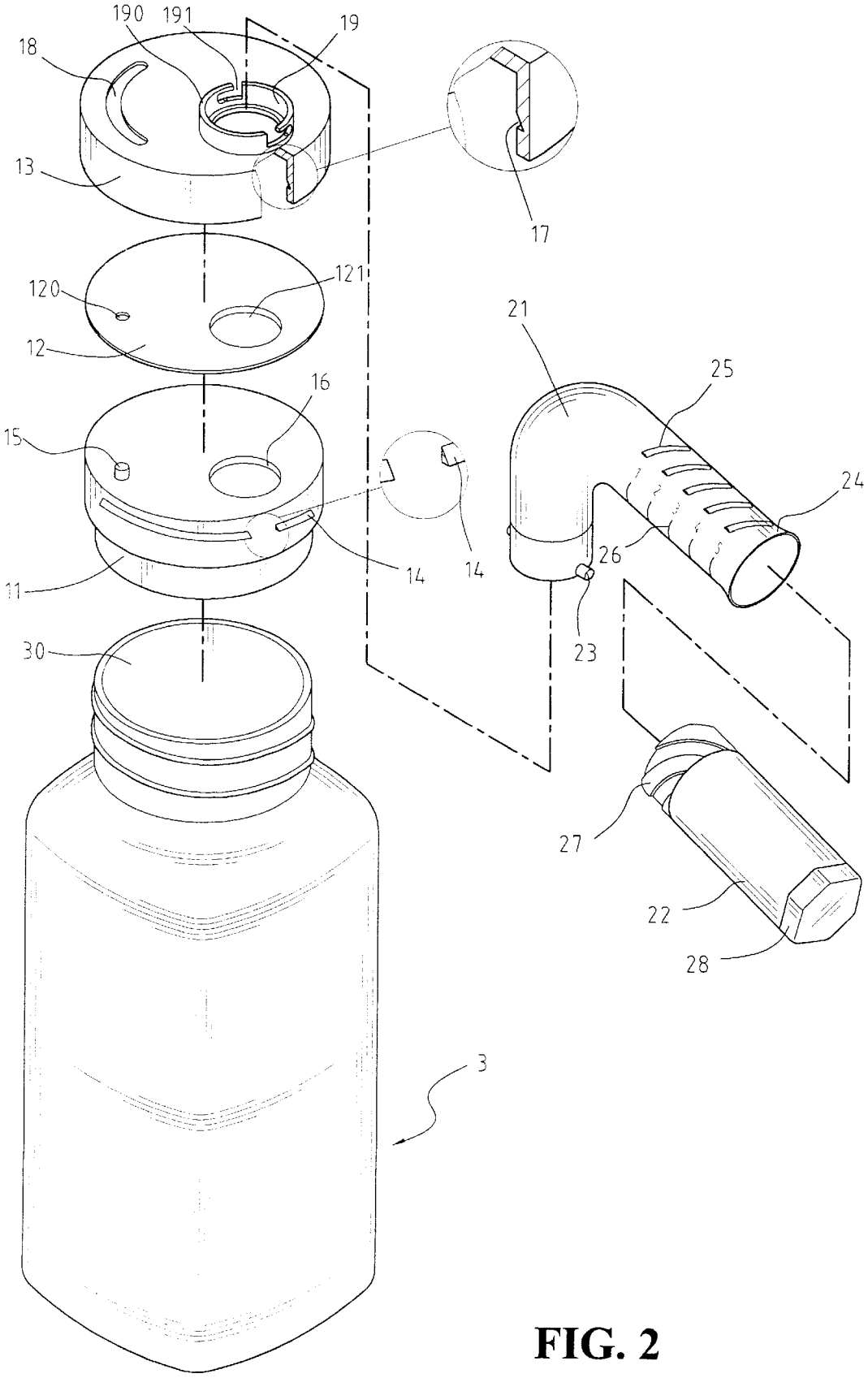
FIG. 2 is an exploded view to show the container assembly of the present invention.
Figure 4:
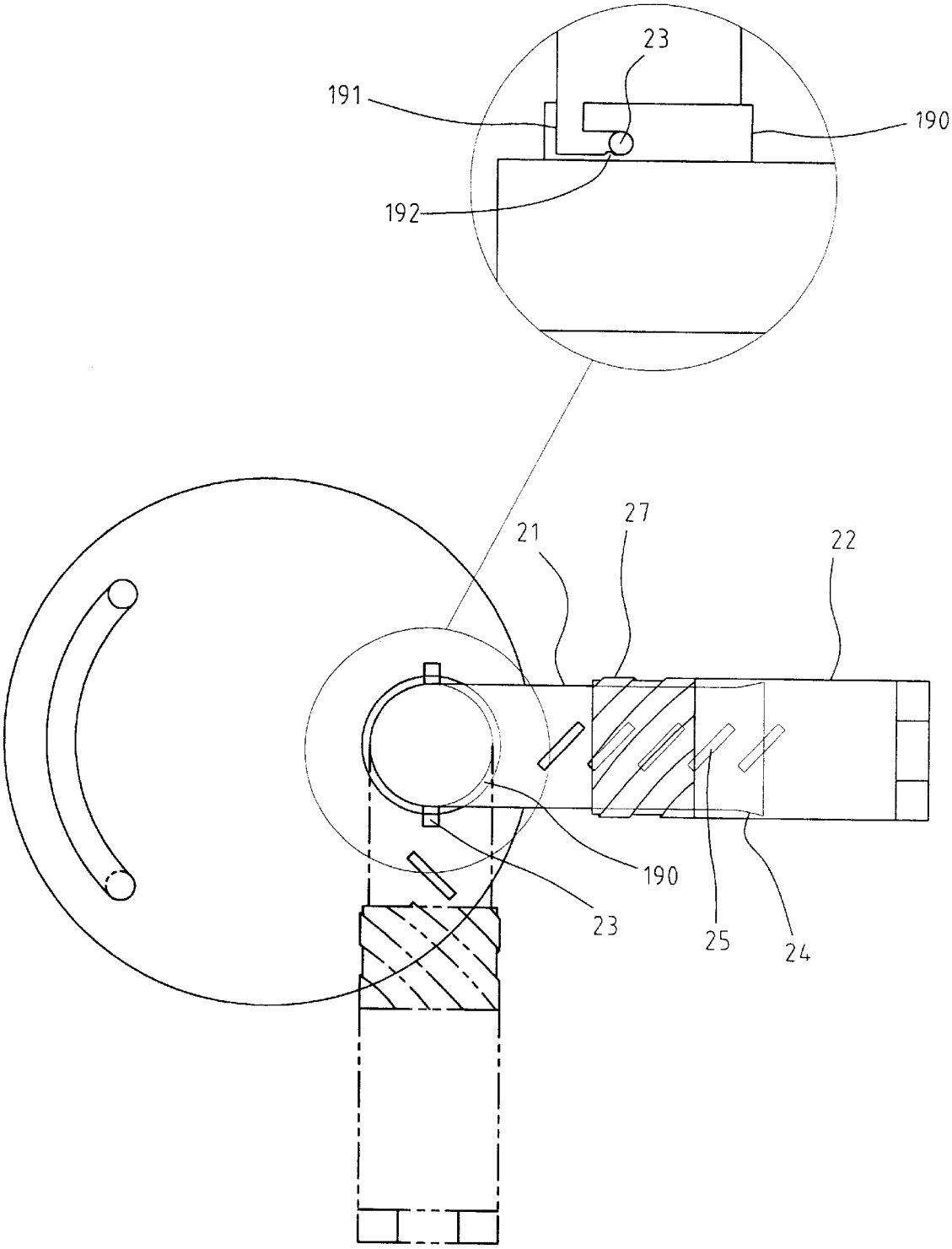
FIG. 4 is a top plan view to show the second cap is rotated by pushing the tube connected to the second cap.

Referring to FIGS. 1, 2 and 4, the container assembly of the present invention comprises a container 3 having an opening 30 and a first cap 11 is mounted to the opening 30. The first cap 11 has a first aperture 16 and a protrusion 15 extends from a top surface of the first cap 11. A plurality of ridges 14 extend from an outer periphery of the first cap 11 and perform as threads.

A second cap 13 is rotatably mounted to the first cap 11 by receiving the ridges 14 on the first cap 11 in grooves 17 defined in an inner side of the second cap 13. The second cap 13 has a slot 18 defined therethrough and the protrusion 15 is movably received in the slot 18. A second aperture 19 is defined through the second cap 13 and can be moved to a position in communication with the first aperture 16. A plate 12 is received between the first cap 11 and the second cap 13, and performs as a seal which minimizes gaps between the first cap 11 and the second cap 13 when the second cap 13 is rotatable relative to the first cap 11. The plate 12 has a first hole 120 for the protrusion 15 extending therethrough, and a second hole 121 which is located in alignment with the first aperture 16. A neck 190 extends from a top surface of the second cap 13 and encloses the second aperture 19. The neck 190 has two L-shaped slots 191 which open to a top edge of the neck 190.

An L-shaped tube 21 has a first open end rotatably engaged with the neck 190 and two pins 23 respectively extend radially outward from the first end of the tube 21 so that the two pins 23 are movably engaged with the two L-shaped slots 191. A boss 192 extends from an inner periphery of a horizontal section of each of the two L-shaped slots 191 so that when the pin 23 moves over the boss 192, the pin 23 is positioned stably as shown in FIG. 4. The tube 21 has first threads 25 defined on an outer periphery thereof and scales 26 marked on the tube 21. An end member 22 is rotatably connected to a second open end 24 of the tube 21, wherein the second open end 24 is an enlarged end so as to prevent the end member 22 from disengaging from the second open end 24. The end member 22 has second threads 27 which arc threadedly connected to the first threads 25. A polygonal piece 28 is connected to a distal end of the end member 22 so that when rotating the polygonal piece 28, the end member 22 can be moved toward or away from the second open end 24 of the tube 21.

Figure 3:
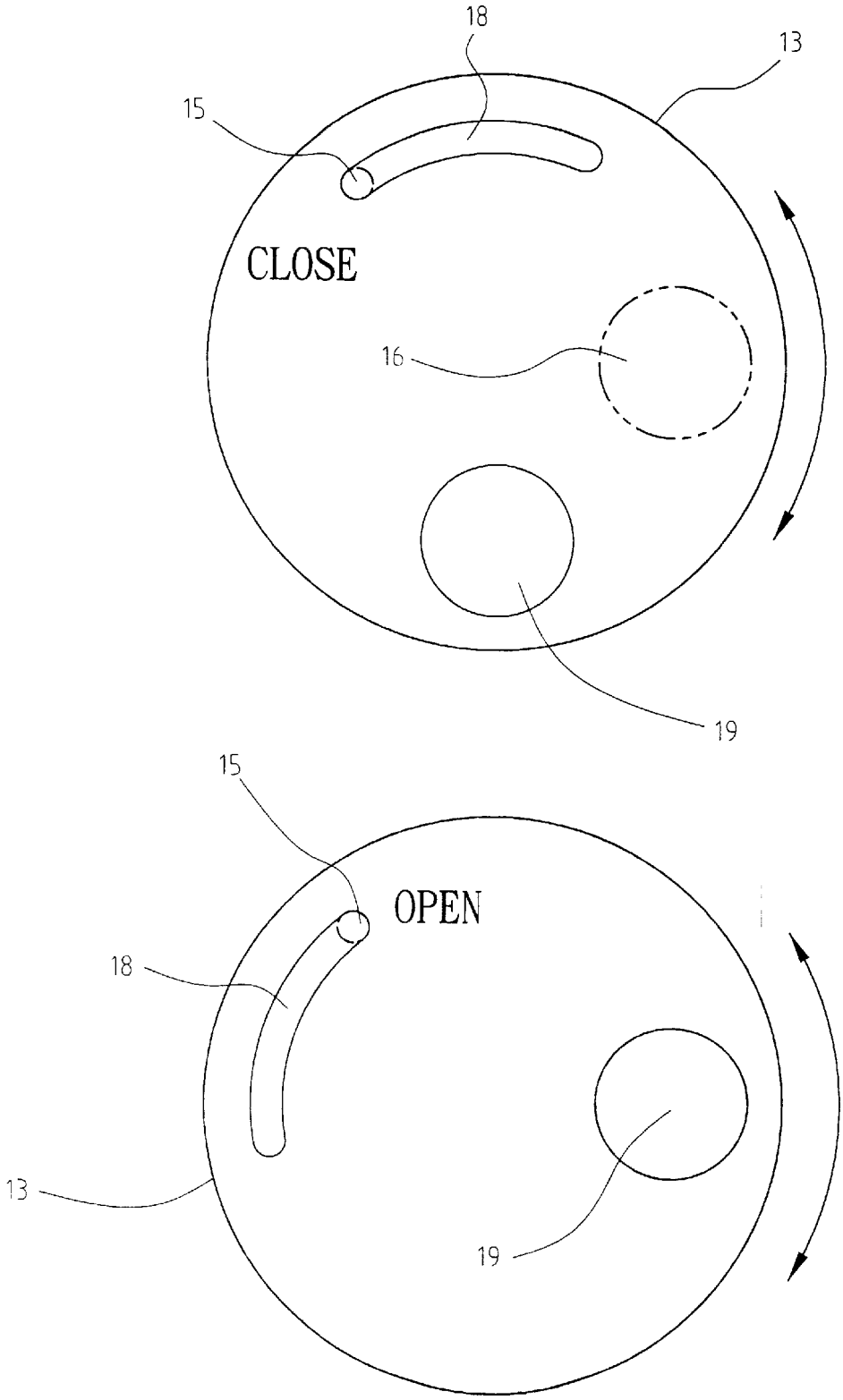
FIG. 3 is an illustrative view to show a close position and an open position of the container assembly when rotating the second cap.

When pivoting the tube 21 counter clockwise to rotate the second cap 13 relative to the first cap 11 which is fixed, the position of the slot 18 is moved and the protrusion 15 is shifted from a close position to an open position as shown in FIG. 3. In the open position, the second aperture 19 is rotated to communicate with the first aperture 16, and the contents such as powder can be poured into the tube 21 and the end member 22. The volume of the powder filled in the end member 22 and the tube 21 can be decided by adjusting the end member 22 as shown in FIG. 4. The second cap 13 is then rotated clockwise to remove the second aperture 19 away from the first aperture 16 so that the first aperture 16 is closed by the second cap 13. Therefore, the powder in the tube 21 and the end member 22 is the desired volume.

Figure 5:
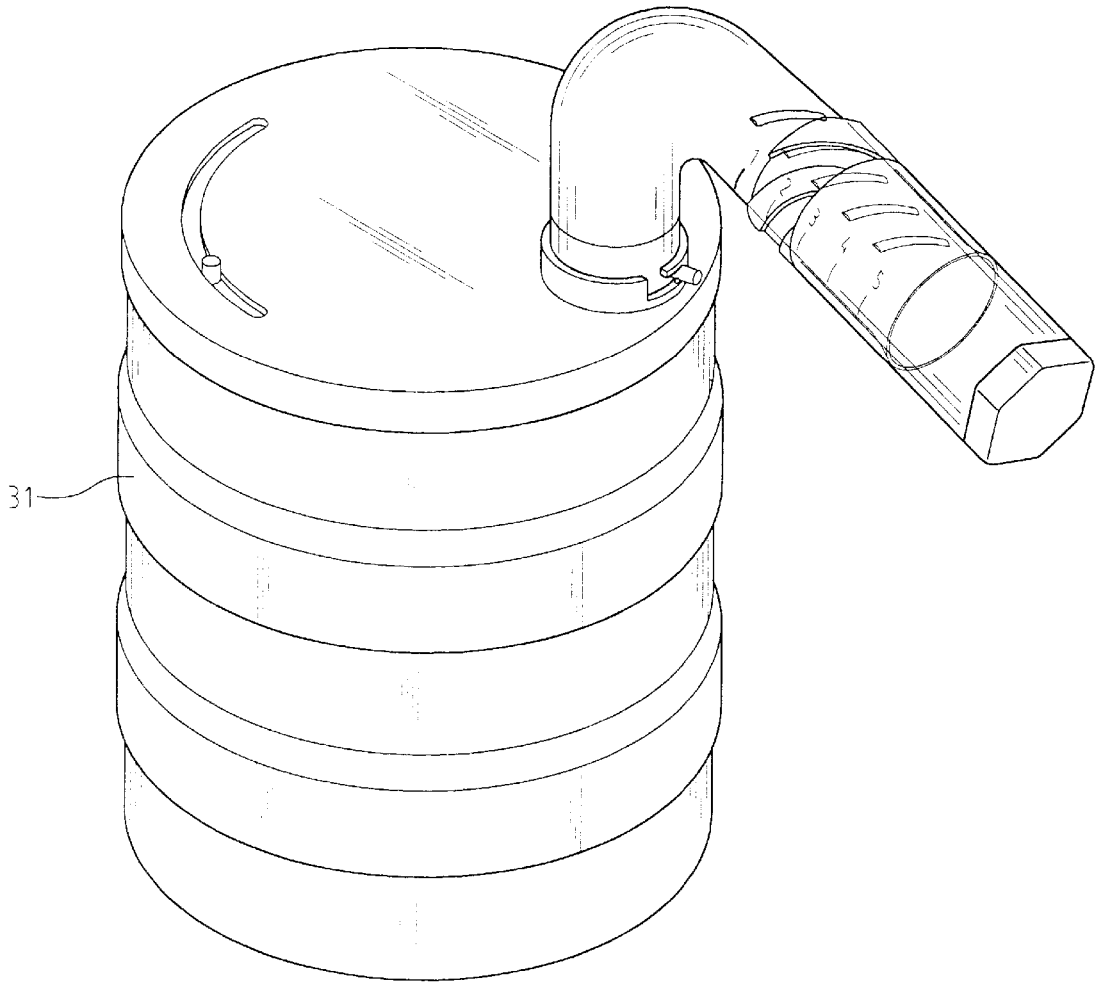
FIG. 5 is a perspective view to show the container assembly of the present invention connected with a milk powder container.

FIG. 5 shows that the container assembly can be used with different type of containers such as a milk powder container 31.

While we have shown and described the embodiment in accordance with the present invention, it should be clear to those skilled in the art that further embodiments may be made without departing from the scope of the present invention.

What is claimed is:

1. A container assembly comprising:

a container having an opening;

a first cap mounted to said opening and having a first aperture, and a protrusion extending from a top surface of said first cap;

a second cap rotatably mounted to said first cap and having a slot and a second aperture defined therethrough, said protrusion movably received in said slot;

a neck extending from a top surface of said second cap and enclosing said second aperture, said neck having two L-shaped slots which open to a top edge of said neck, a tube having a first open end rotatably engaged with said second aperture, and two pins respectively extending radially outward from said first open end and movably engaged with said two L-shaped slots; and an end member rotatably connected to a second open end of said tube.

2. The assembly as claimed in claim 1, further comprising a plate received between said first cap and said second cap, said plate having a first hole and a second hole, said protrusion extending through said first hole and said second hole located in alignment with said first aperture.

3. The assembly as claimed in claim 1, wherein said end member has a polygonal piece connected to a distal end thereof.

4. The assembly as claimed in claim 1, wherein said tube has first threads defined on an outer periphery thereof and said end member has second threads which are threadedly connected to said first threads.

* * * * *